US010866057B2

(12) United States Patent
Schlangen

(10) Patent No.: US 10,866,057 B2
(45) Date of Patent: Dec. 15, 2020

(54) ARCHERY BOW STABILIZER WITH ADJUSTABLE STIFFNESS AND DIRECTION OF FLEX

(71) Applicant: Jacob Schlangen, Avon, MN (US)

(72) Inventor: Jacob Schlangen, Avon, MN (US)

( * ) Notice: Subject to any disclaimer, the term of this patent is extended or adjusted under 35 U.S.C. 154(b) by 163 days.

(21) Appl. No.: 15/837,228

(22) Filed: Dec. 11, 2017

(65) Prior Publication Data

US 2019/0178604 A1 Jun. 13, 2019

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89
See application file for complete search history.

(56) References Cited

U.S. PATENT DOCUMENTS 4,054,121 A * 10/1977 Hoyt, Jr. ..... F41B 5/1426 124/89
4,893,606 A * 1/1990 Sisko ..... F41B 5/1426 124/89
5,090,396 A * 2/1992 Bickel ..... F41B 5/1426 124/88
5,273,022 A * 12/1993 Leven ..... F41B 5/1426 124/88
5,370,104 A * 12/1994 Neie ..... F41B 5/1426 124/89
5,611,325 A * 3/1997 Kudlacek ..... F41B 5/1426 124/89
6,186,135 B1 * 2/2001 Harwath ..... F41B 5/1426 124/89
6,431,163 B1 * 8/2002 Chipman ..... F41B 5/1426 124/89
7,318,430 B2 * 1/2008 Leven ..... F41B 5/1426 124/89
8,225,778 B2 * 7/2012 Walk ..... F41G 1/467 124/89
8,347,870 B1 * 1/2013 Mahutga ..... F41B 5/1426 124/89
8,893,700 B2 * 11/2014 Kozlik ..... F41B 5/1426 124/89
9,038,618 B1 * 5/2015 Bomar ..... F41B 5/1426 124/89
9,347,732 B2 * 5/2016 Bidigare ..... F41B 5/1426
2011/0030666 A1 * 2/2011 Darlington ..... F41B 5/123 124/25
2013/0139798 A1 * 6/2013 Khoshnood ..... F41B 5/143 124/44.5

* cited by examiner

*Primary Examiner* — Alexander R Niconovich
(74) *Attorney, Agent, or Firm* — Vidas Arrett & Steinkraus P.A.

(57) ABSTRACT

The inventive stabilizer controls the stiffness, spine, flex and flex direction of the bow. The archery stabilizer has a rod having first and second ends; first and second end caps connected to the first and second ends of the rod, and at least three stiffening members extending between the first and second end caps, each of the at least three stiffening members being constructed and arranged to selectively change the tension between the first and second end caps.

16 Claims, 29 Drawing Sheets

ARCHERY BOW STABILIZER WITH ADJUSTABLE STIFFNESS AND DIRECTION OF FLEX

CROSS-REFERENCE TO RELATED APPLICATIONS

Not Applicable

STATEMENT REGARDING FEDERALLY SPONSORED RESEARCH

Not Applicable

FIELD OF THE INVENTION

The invention relates to a stabilizer, and more specifically a stabilizer having three or more wires which can be adjustably tightened or loosened to control the stiffness, flex, spine and flex direction of the stabilizer.

BACKGROUND OF THE INVENTION

A stabilizer connected to an archery bow, by screwing it into a threaded accessory hole located just below the grip. Nearly all compound and Olympic recurve bows come from the factory with this accessory hole standard.

Stabilizers perform a variety of functions. They absorb vibrations in the bow at the shot, which reduces the shock felt in your hand on the bow grip, and makes the bow quieter. They help keep the bow balanced, by adding weight below the grip. That weight down low encourages the bow to stand up straight, which is critical for consistent accuracy. It also helps settle your sight as you aim at the target. Stabilizers combat bow torque or flex. When an archer releases the bowstring, the riser torques or flexes as all that energy hits it. But a stabilizer, which adds weight out in front of the bow, resists that torque.

BRIEF SUMMARY OF THE INVENTION

The inventive stabilizer controls the stiffness, spine, flex and flex direction of the bow. The archery stabilizer has a rod having first and second ends; first and second end caps connected to the first and second ends of the rod, and at least three stiffening members extending between the first and second end caps, each of the at least three stiffening members being constructed and arranged to selectively change the tension between the first and second end caps.

The rod is preferably a carbon fiber rod, but can be made of any material which provides suitable strength, such as metal or plastic. The rod has threaded ends to threadably engage with the end caps.

The archery stabilizer can have three or more stiffening members or wires, which can be made of wire or rope and are preferably coated in Kevlar.

By changing the length of the wires between the end caps, the stabilizer changes the load on the rod and therefore controls the stiffness, spine, flex and flex direction of the stabilizer.

The stabilizer can be attached to an archery bow, either to the front mount, the rear mount, in a V-bar arrangement or a side-bar arrangement, or any combination thereof.

The stabilizer can also have two or more supports spaced between the end caps, which aid in controlling the flex and flex direction of the stabilizer.

DETAILED DESCRIPTION OF THE INVENTION

Figure 1:
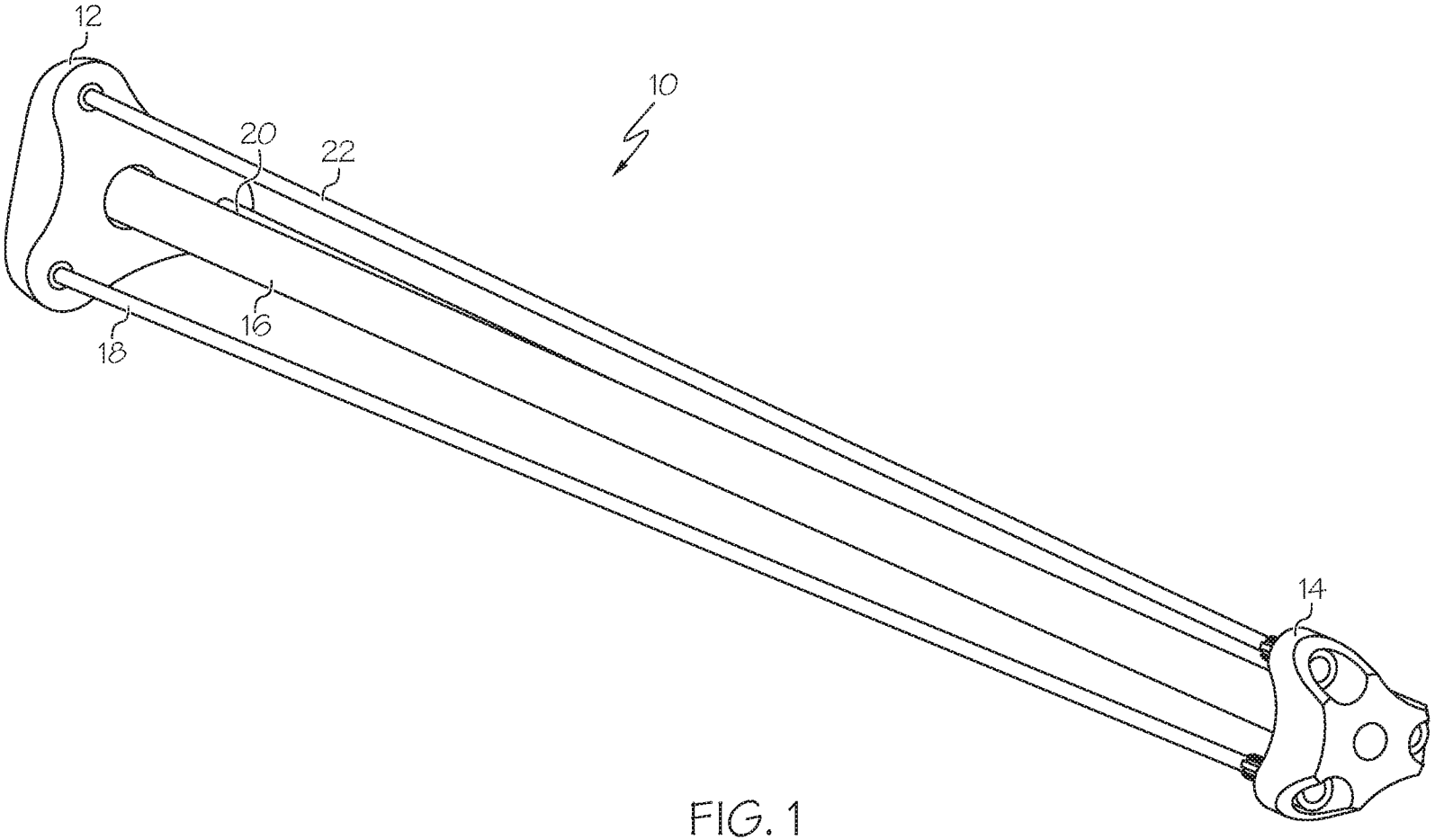
FIG. 1 is a perspective view of a first embodiment of the invention.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 is a perspective view of a first embodiment of the invention, shown generally at 10. The stabilizer 10 has two end caps 12 and 14, connected by a carbon fiber rod 16, which has threaded ends and which mate with threaded openings in the end caps 12 and 14. Three Kevlar coated wires 18, 20 and 22 connected the end caps, which are spaced apart from each other and each wire can be selectively tightened or loosened to control the stiffness and flex of the rod 16. By selectively tightening or loosening the wires, you can change the flex, spine, and flex direction of the stabilizer to put different degrees of a load on the rod and also against each other. It should be understood that the invention could also be made with four, five or more wires, if desired.

The stabilizer works by adjusting the wires or cords (which these could be made of any wire or rope material) changing the load on center rod 16. By doing this you control the stiffness and direction of the flex of energy being caused by firing of the bow. The stabilizer design can work with 3 or more wires or cords. The more wires or cords the more adjustable the stabilizer is. The center rod material is carbon but can be any tube that has sufficient structural integrity to it, such as carbon fiber, metal of plastics.

Figure 2:
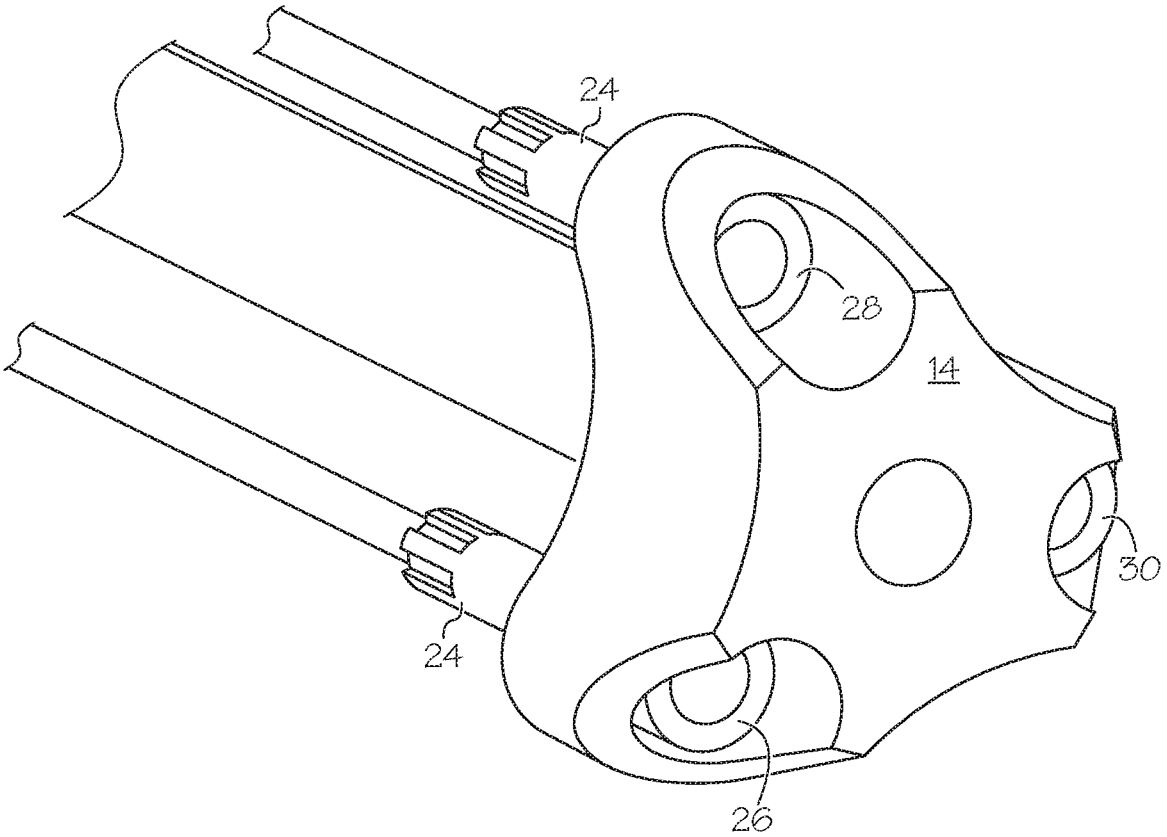
FIG. 2 is a perspective view of the adjustable end 14 of the stabilizer.
Figure 3:
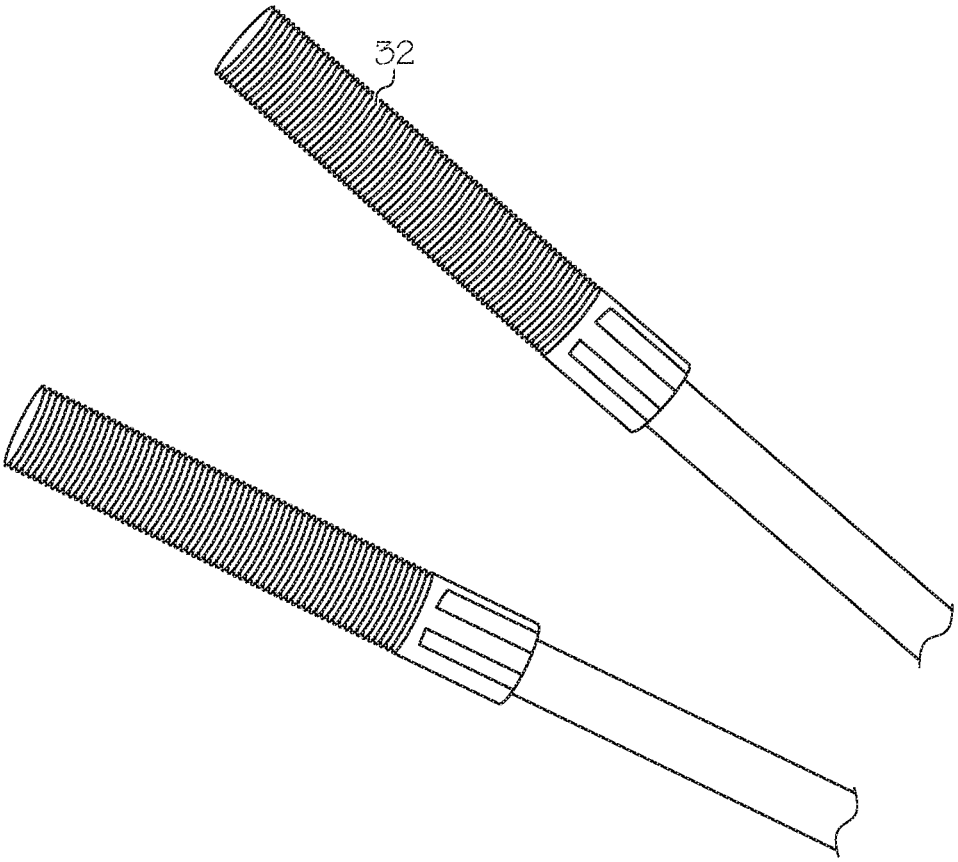
FIG. 3 shows the threaded ends of the wires.
Figure 4:
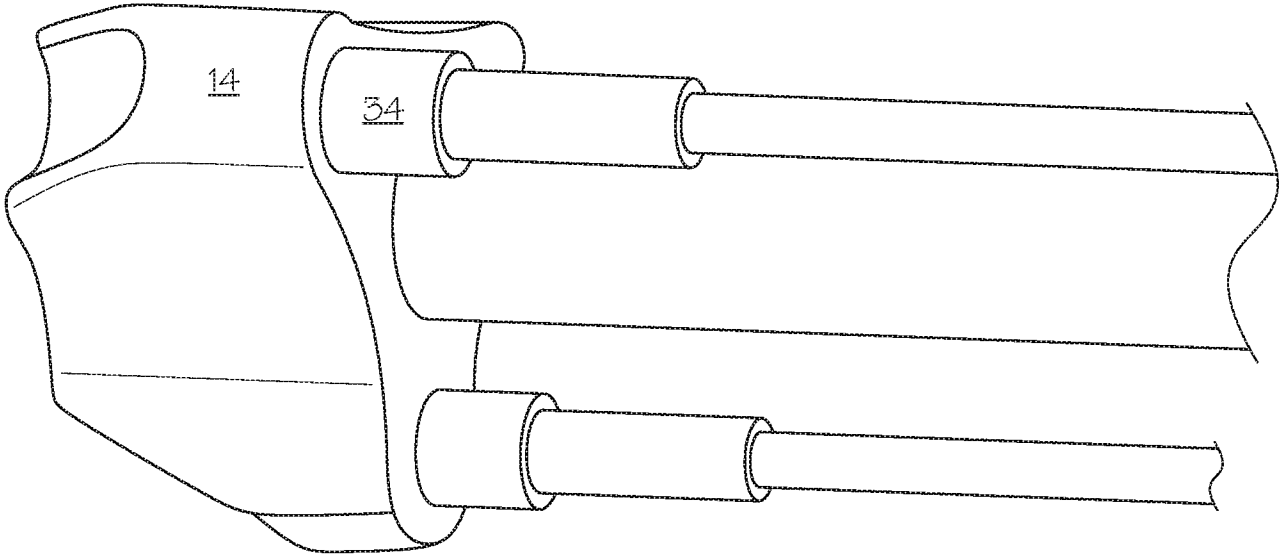
FIG. 4 shows nuts 34 attached to the threaded ends of the wires.

Referring now to FIG. 2-4, FIG. 2 is a perspective view of the adjustable end of the stabilizer showing crimps 24 which connect the wires 18, 20 and 22 to hex heads 26, 28 and 30, which rotate independently of the crimps 24 to tighten or loosen the tension of wires 18, 20 and 22 between the two end caps 12 and 14. FIG. 3 shows that one end of the wires 18, 20 and 22 have threaded ends at 32. FIG. 4 shows that hex heads 26, 28 and 30 are connected to nuts 34, so that when a hex head is rotated, the wire 18, 20 or 22 is shortened or lengthened between end caps 12 and 14, thereby allowing selective control of the stiffness on rod 16, to control the flex, spine and flex direction of the stabilizer.

Figure 5:
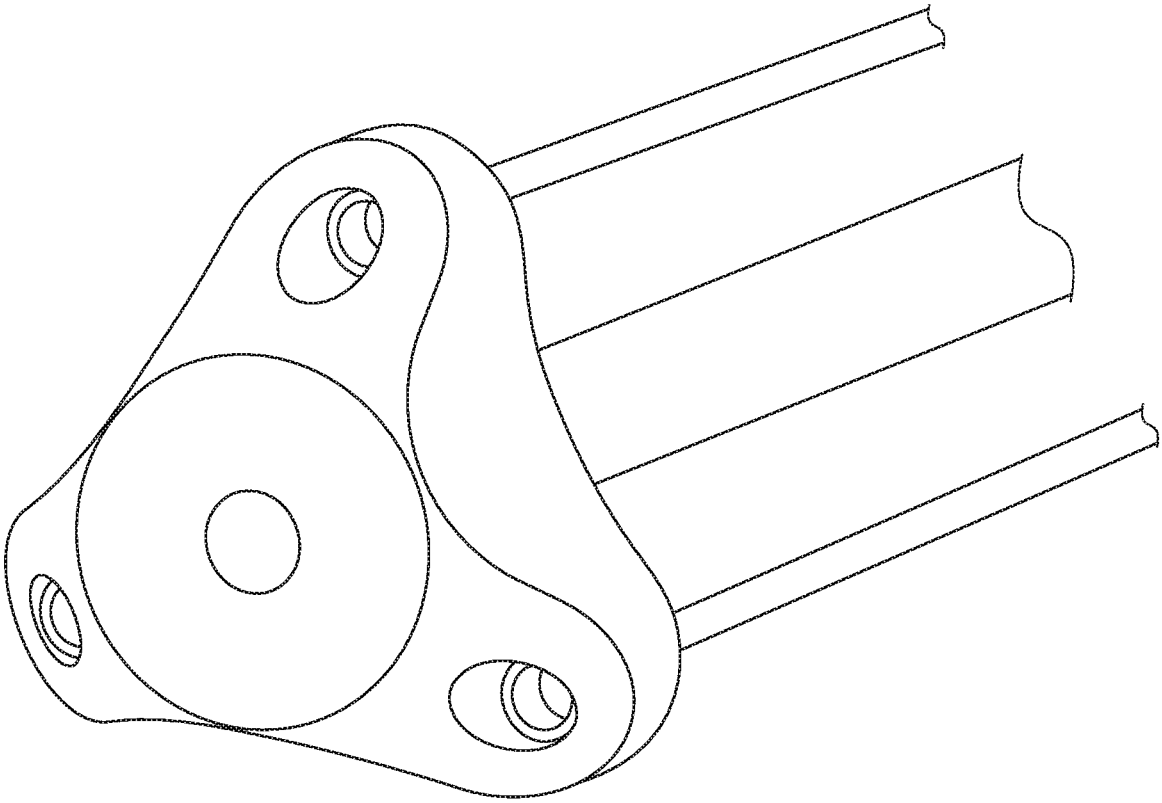
FIG. 5 shows the anchor end of the stabilizer.
Figure 6:
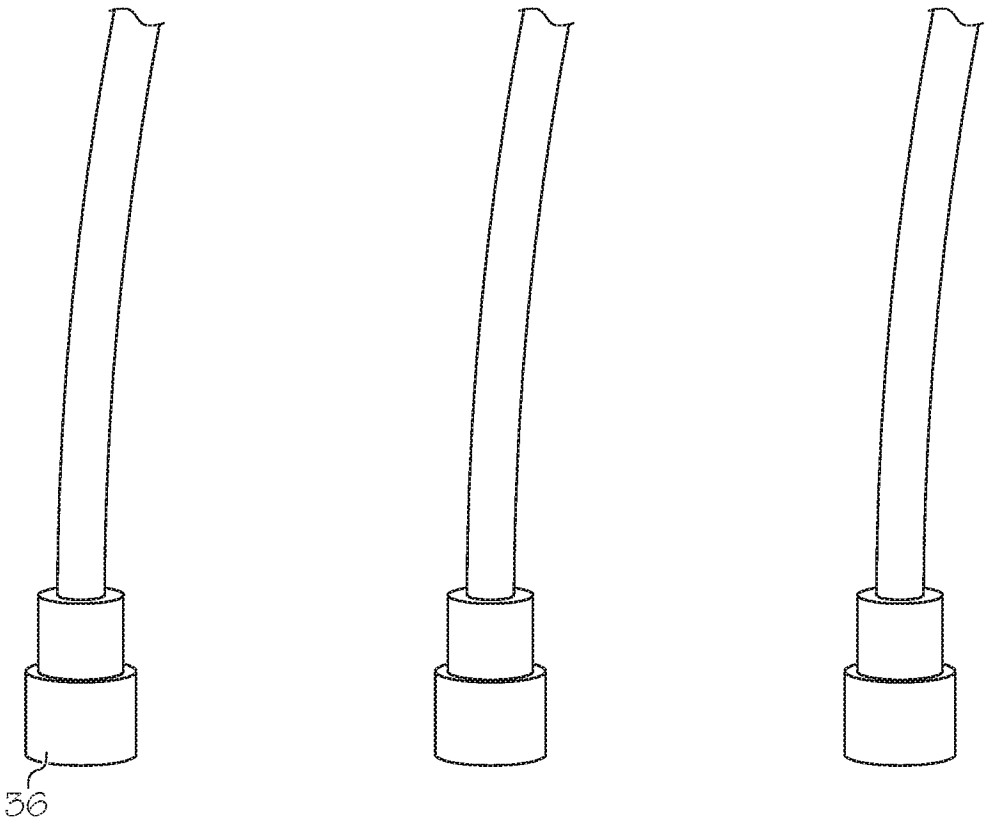
FIG. 6 shows anchor end 36 attached to one end of the wires.

FIG. 5 shows the anchor end of the stabilizer. FIG. 6 shows the cable attached to the anchor end 36, which fit into the through holes of end cap 12.

Figure 7:
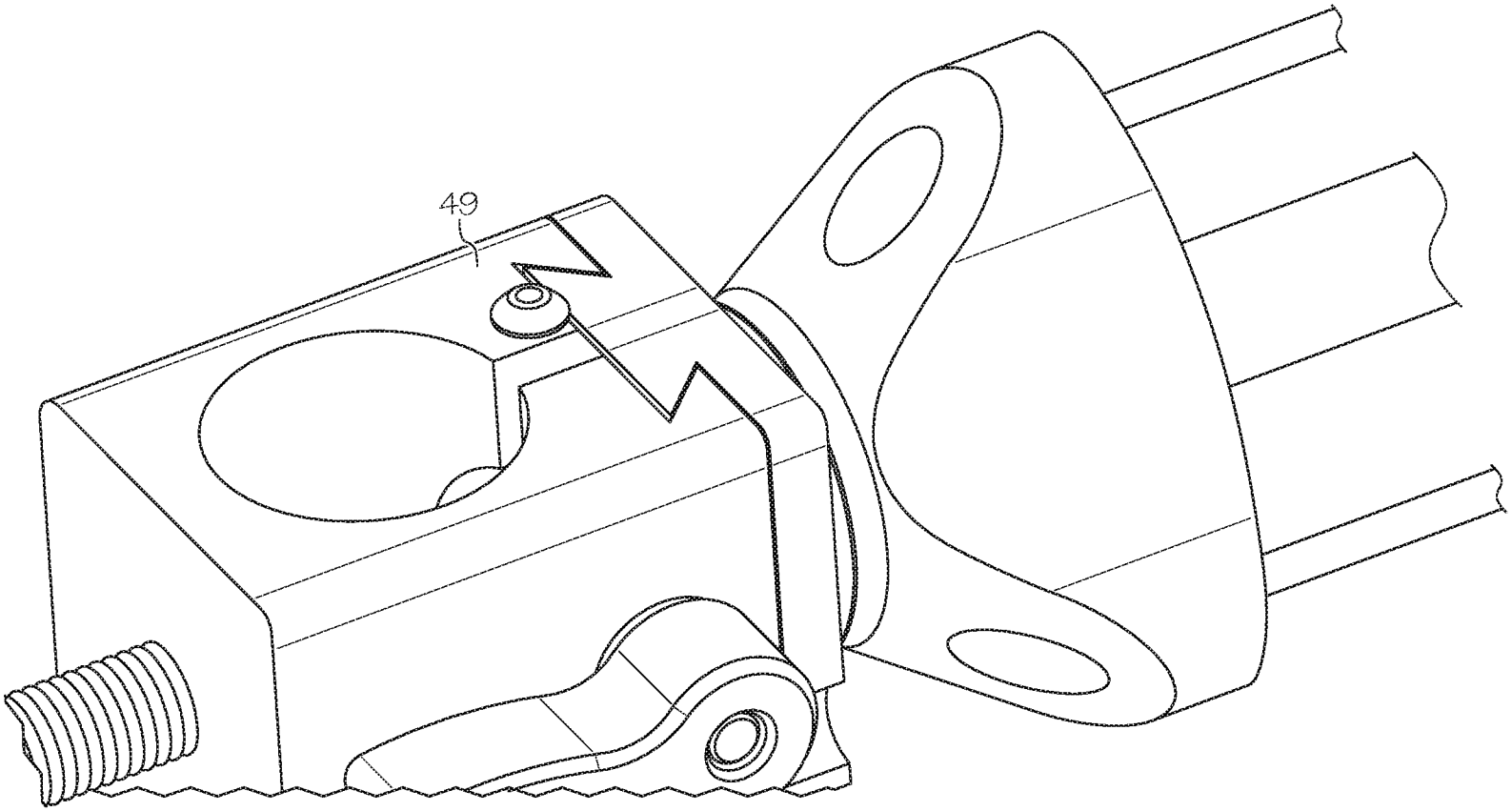
FIG. 7 shows a quick disconnect used to attach the stabilizer to an archery bow.
Figure 8:
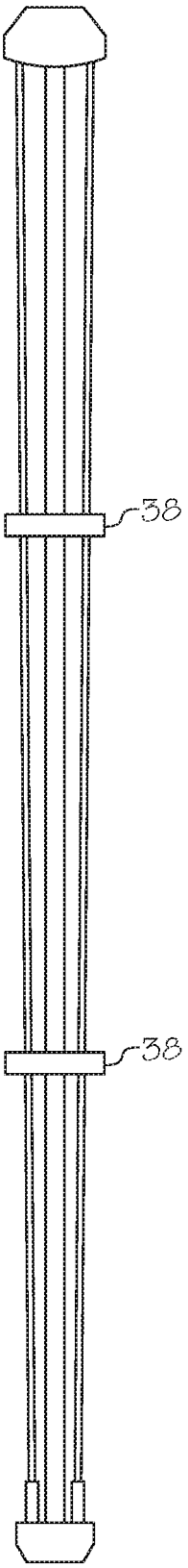
FIG. 8 is a front view of a second embodiment of the invention, with two supports spaced between the end caps.

FIG. 7 shows a quick disconnect 49 for attaching one or more stabilizers to an archery bow. Referring now to FIGS. 19-22, the quick disconnect is shown at 49, and a plate 50 is threadably attached to the stabilizer, and in turn is clamped in slot 52.

Figure 9:
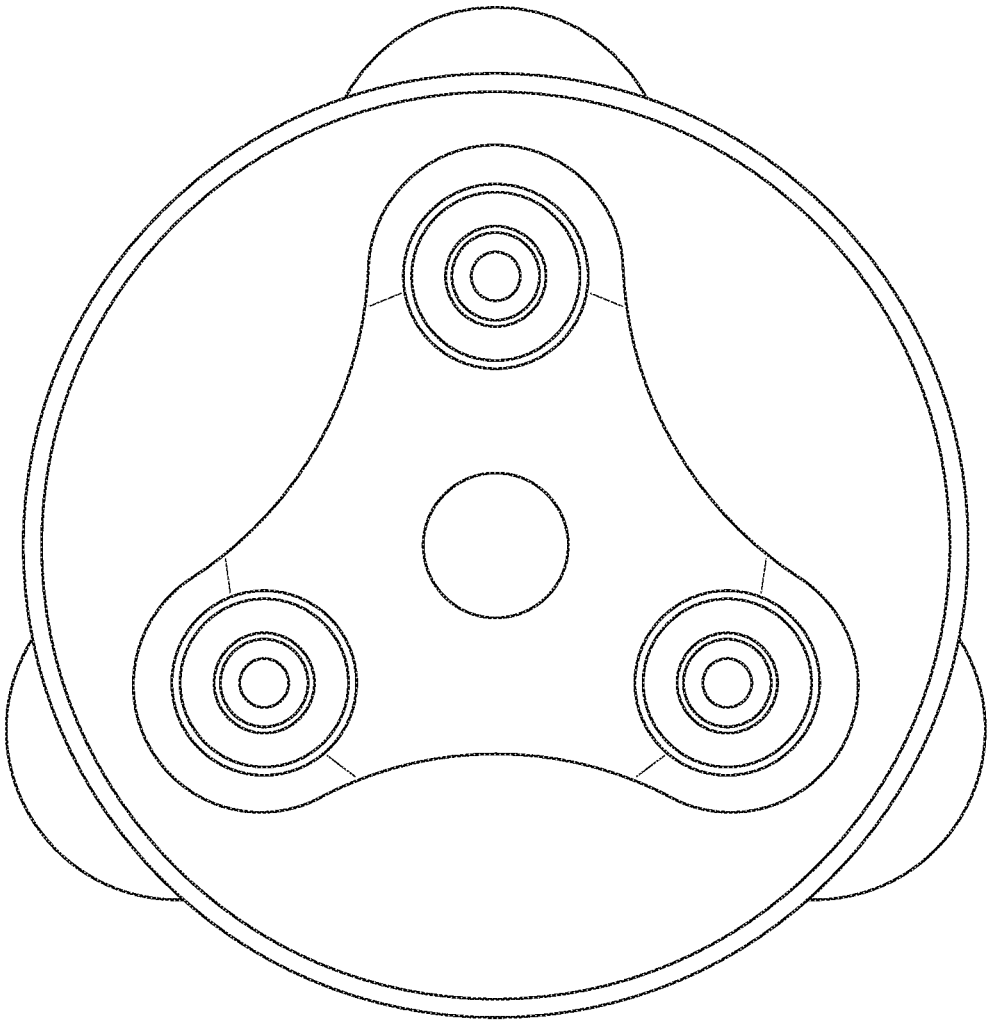
FIG. 9 is a bottom view of the second embodiment.
Figure 10:
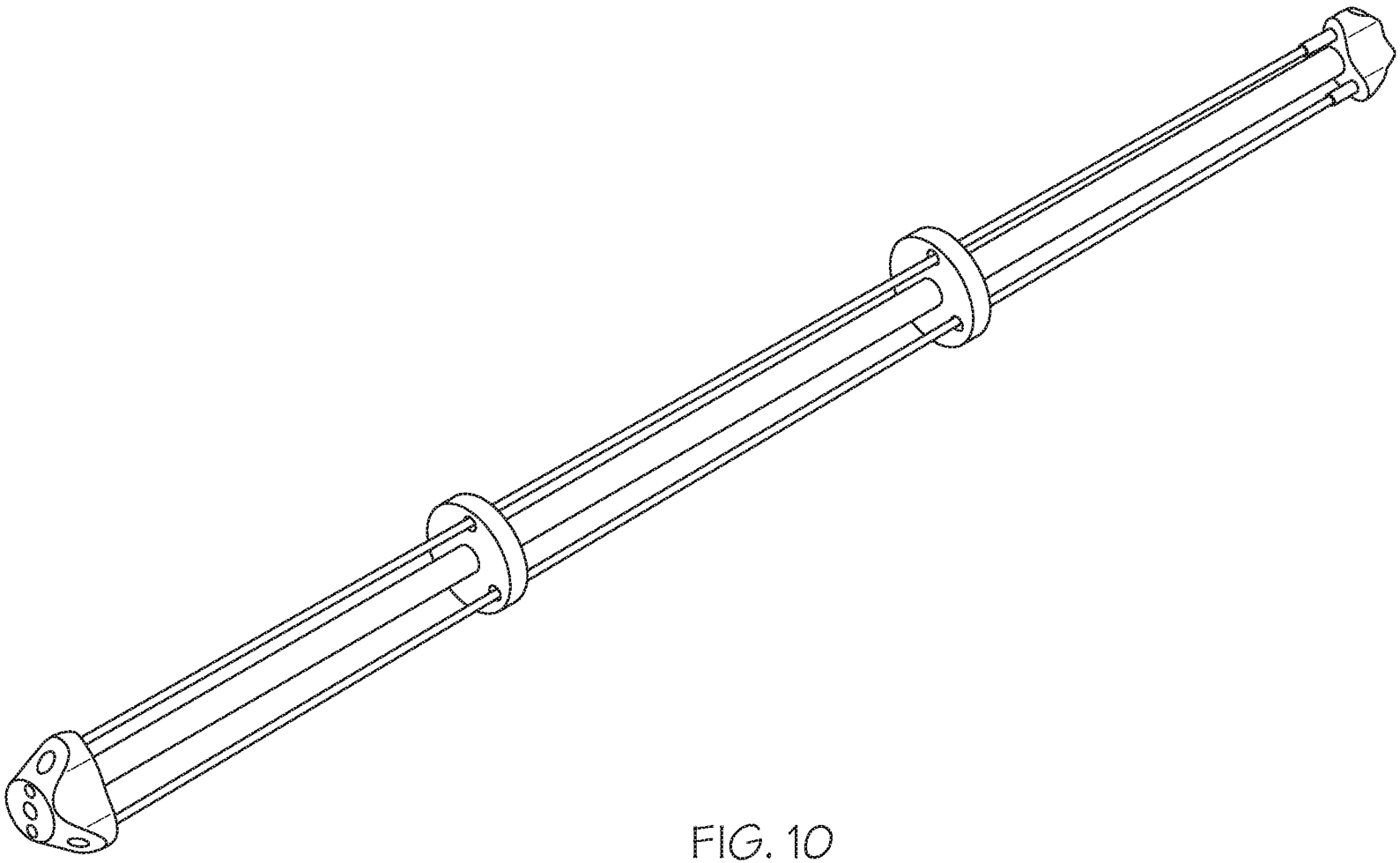
FIG. 10 is a perspective view of the second embodiment.
Figure 11:
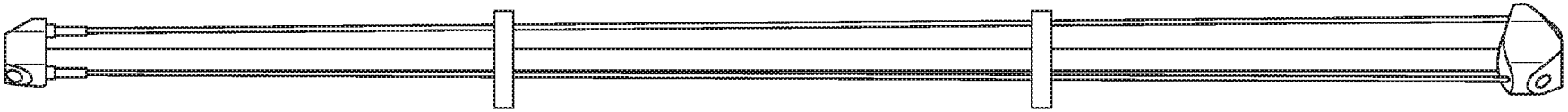
FIG. 11 is a left view of the second embodiment.
Figure 12:
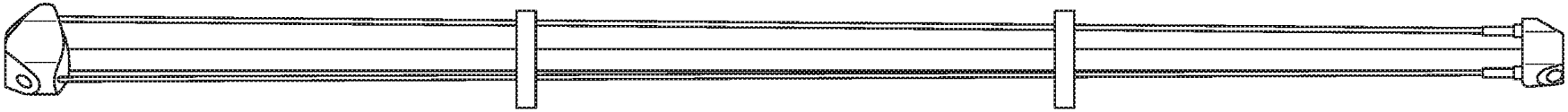
FIG. 12 is a right view of the second embodiment.
Figure 13:
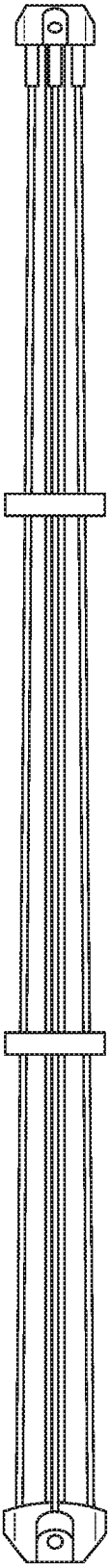
FIG. 13 is a back view of the second embodiment.
Figure 14:
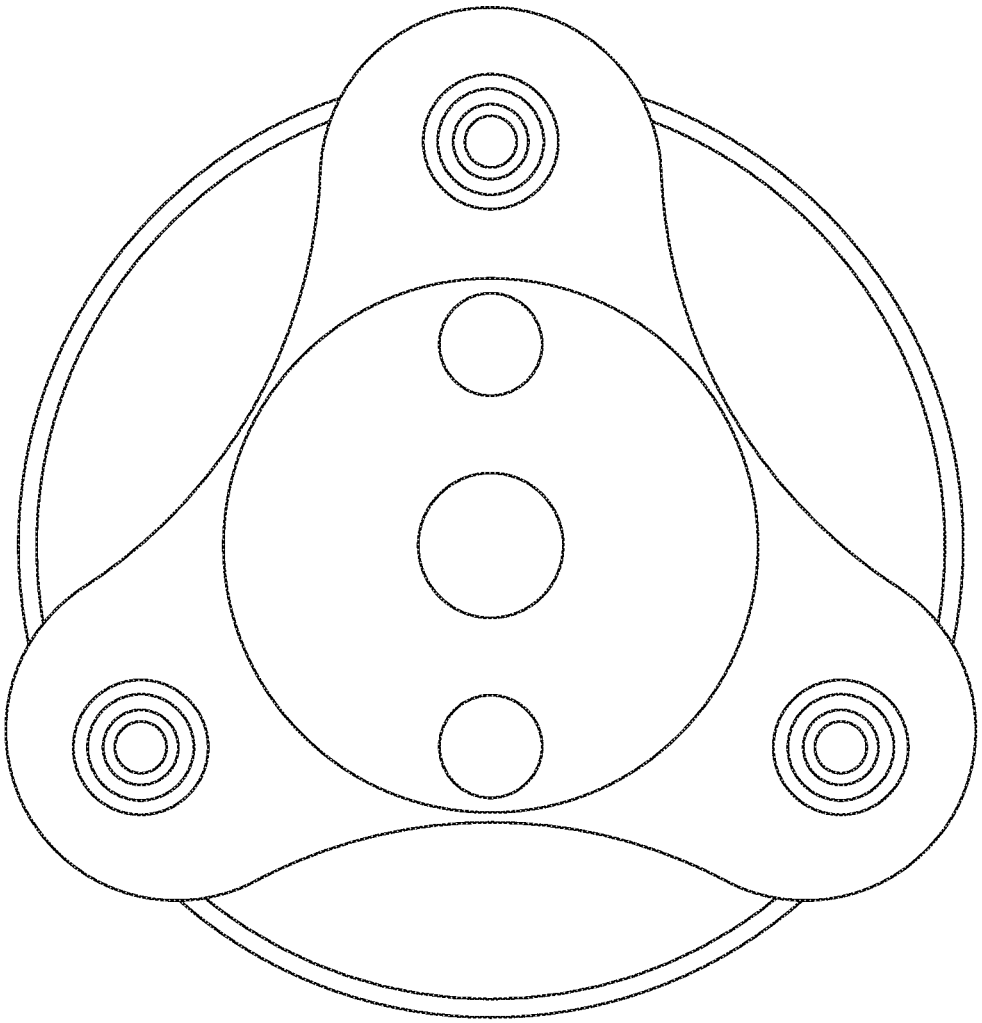
FIG. 14 is a top view of the second embodiment.
Figure 15:
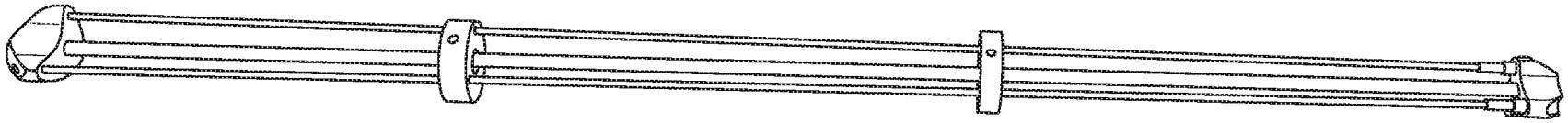
FIG. 15 shows that the supports use a set screw to secure them to the carbon rod.

Referring now to FIGS. 8-14, FIG. 8 is a front view of a second embodiment of the invention, with two supports 38 spaced between the end caps. The supports help with the control of the flex, spine and flex direction of the stabilizer. FIG. 9 is a bottom view of the second embodiment. FIG. 10 is a perspective view of the second embodiment. FIG. 11 is a left view of the second embodiment. FIG. 12 is a right view of the second embodiment. FIG. 13 is a back view of the second embodiment. FIG. 14 is a top view of the second embodiment. FIG. 15 shows that the supports use a set screw to secure them to the carbon rod.

Figure 16:
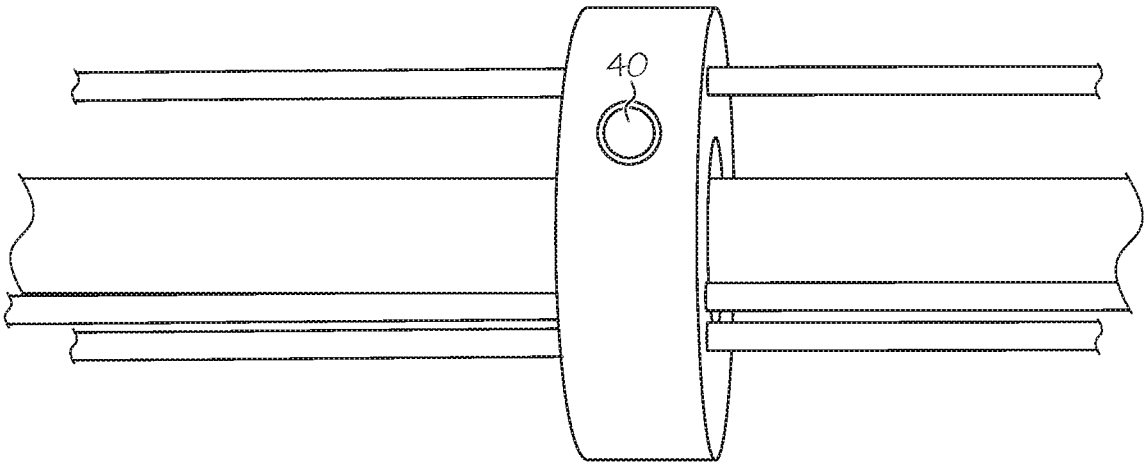
FIG. 16 shows a close up of the set screw.

FIG. 16 shows a close up of the set screw 40 which is used to secure support 38 to the carbon fiber rod 16.

Figure 17:
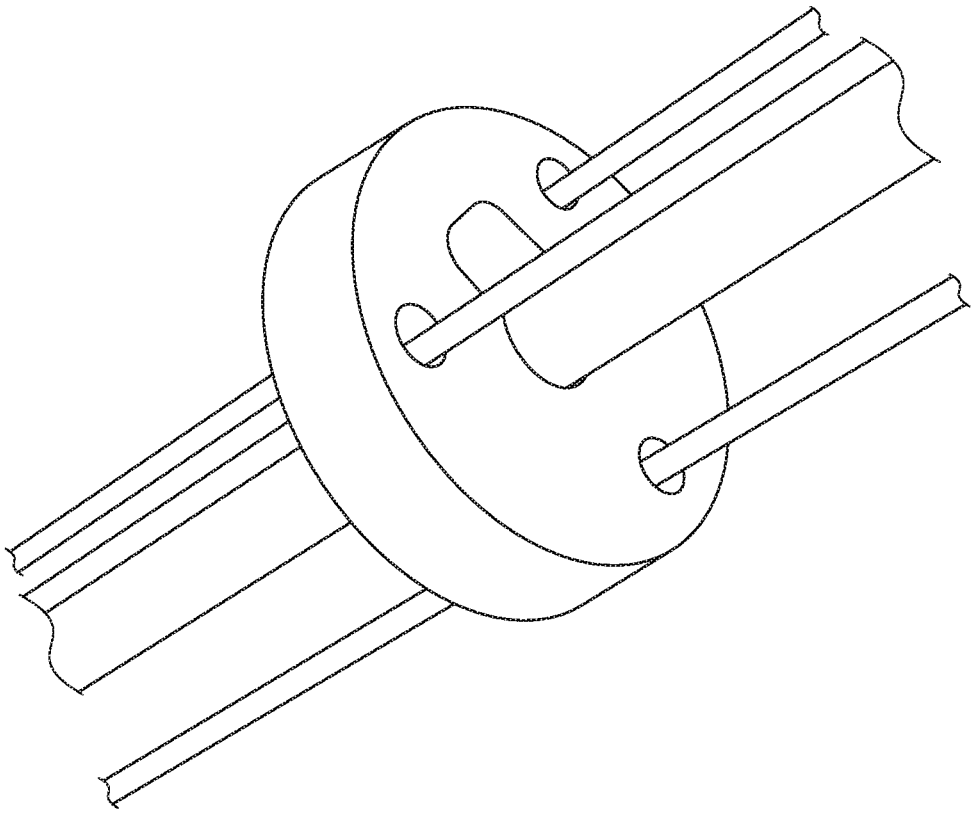
FIG. 17 shows a perspective view of the support.

FIG. 17 shows a perspective view of the support 38.

Figure 18:
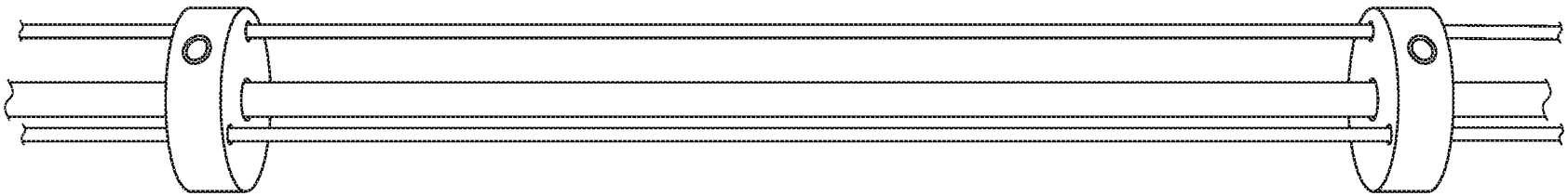
FIG. 18 shows both supports.

FIG. 18 shows both supports 38 of the second embodiment.

Figure 19:
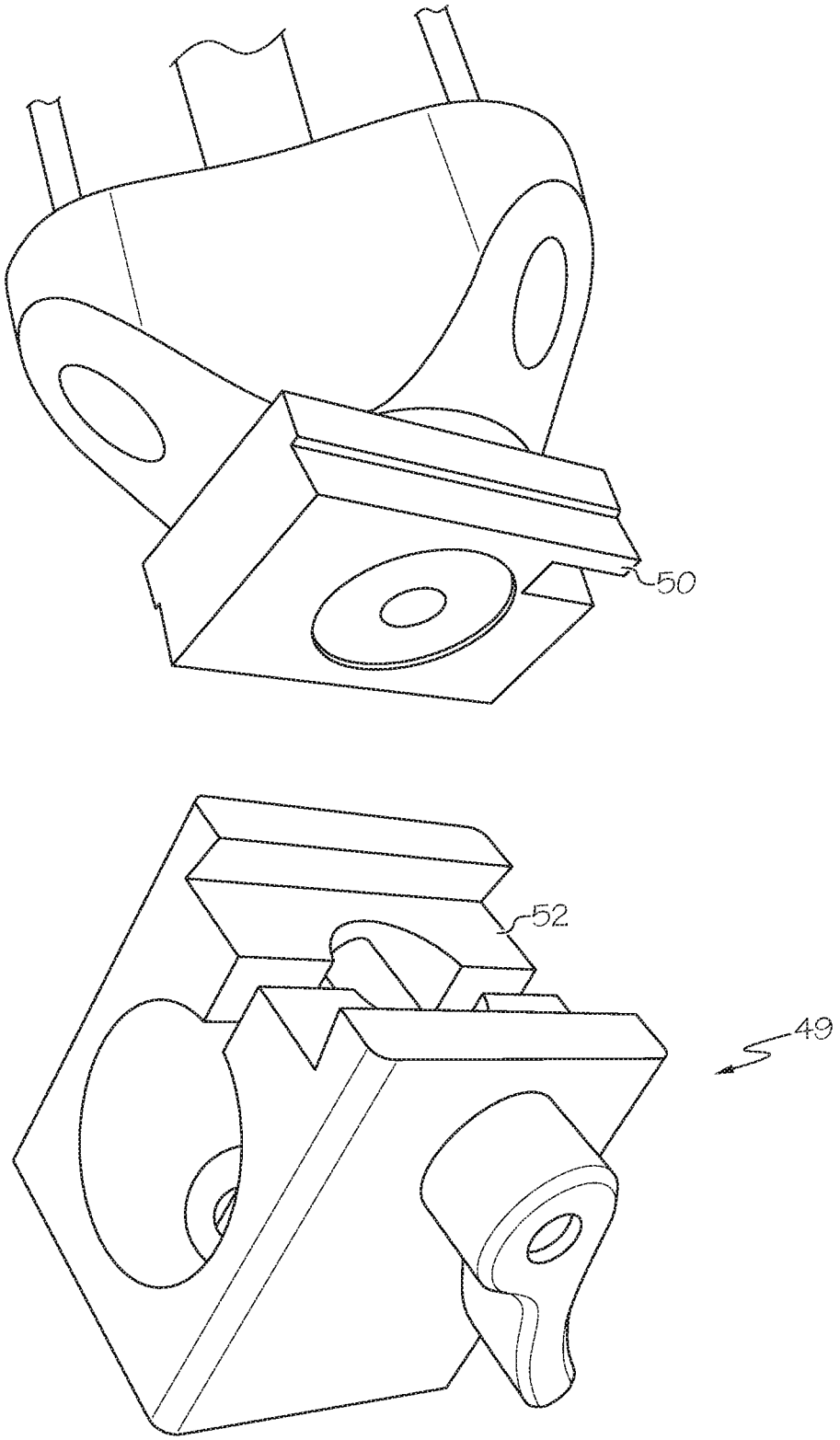
FIG. 19 shows the quick disconnect unattached from a stabilizer.

FIG. 19 shows the quick disconnect unattached from a stabilizer.

Figure 20:
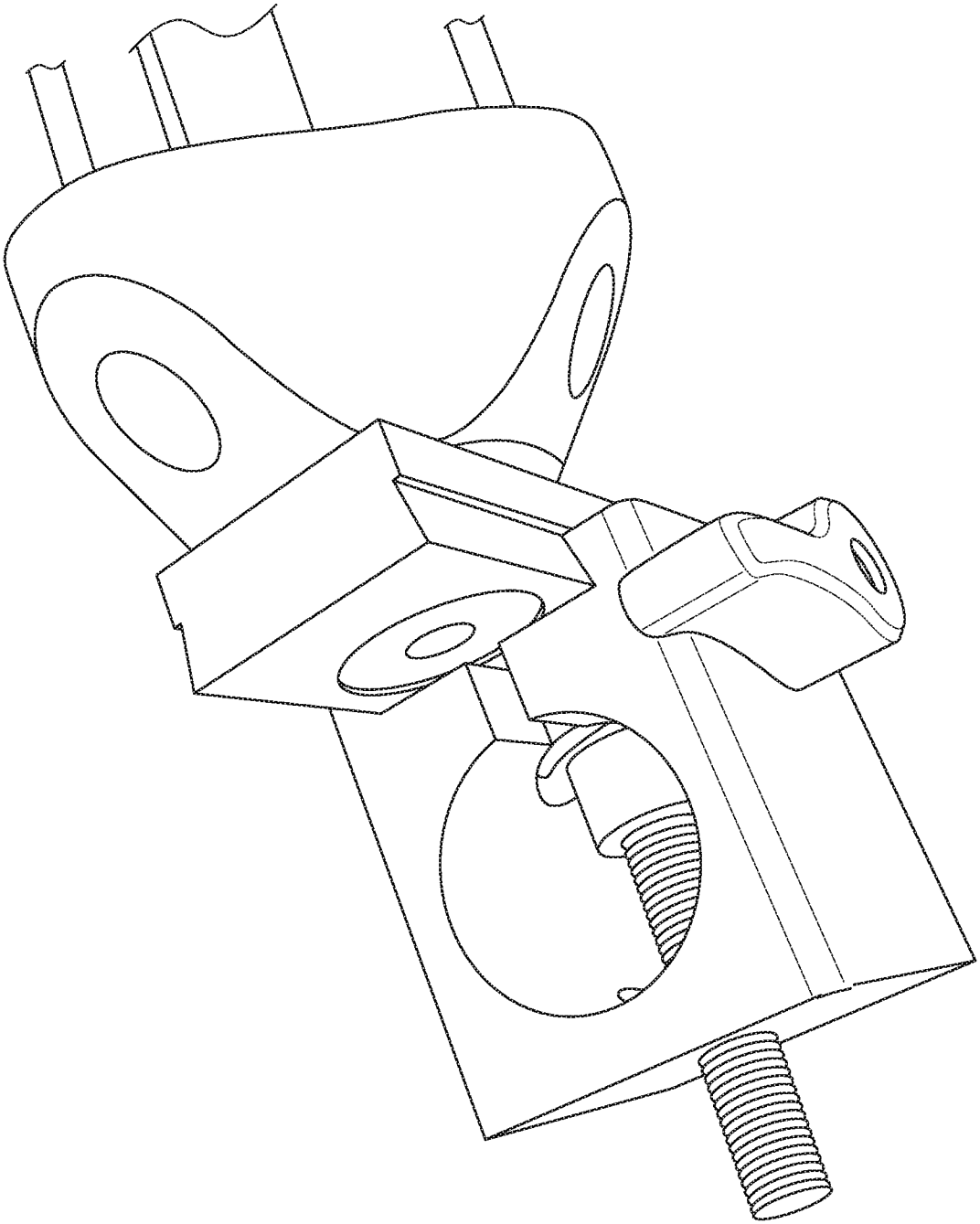
FIG. 20 shows the quick disconnect partially attached to a stabilizer.

FIG. 20 shows the quick disconnect partially attached to a stabilizer.

Figure 21:
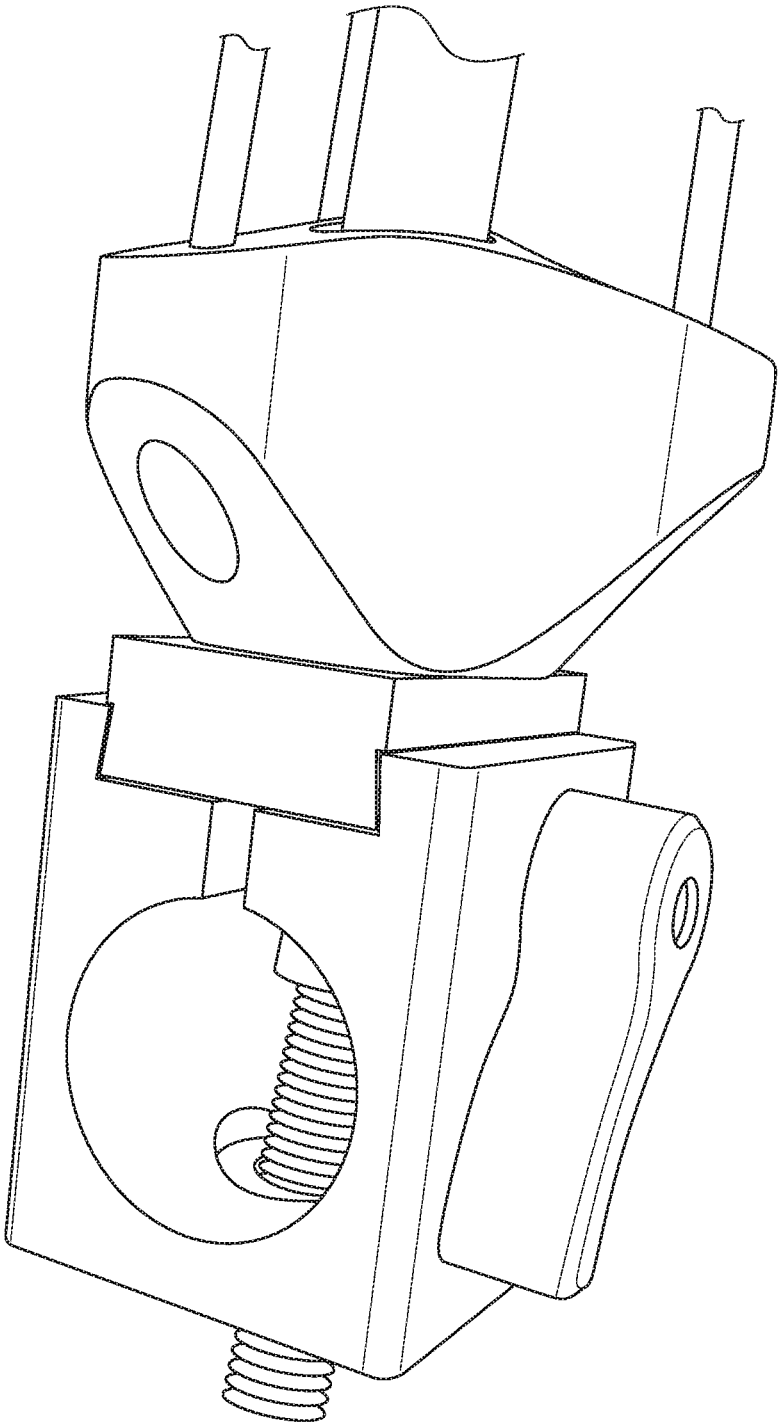
FIG. 21 shows the quick disconnect fully connected to a stabilizer.

FIG. 21 shows the quick disconnect fully connected to a stabilizer.

Figure 22:
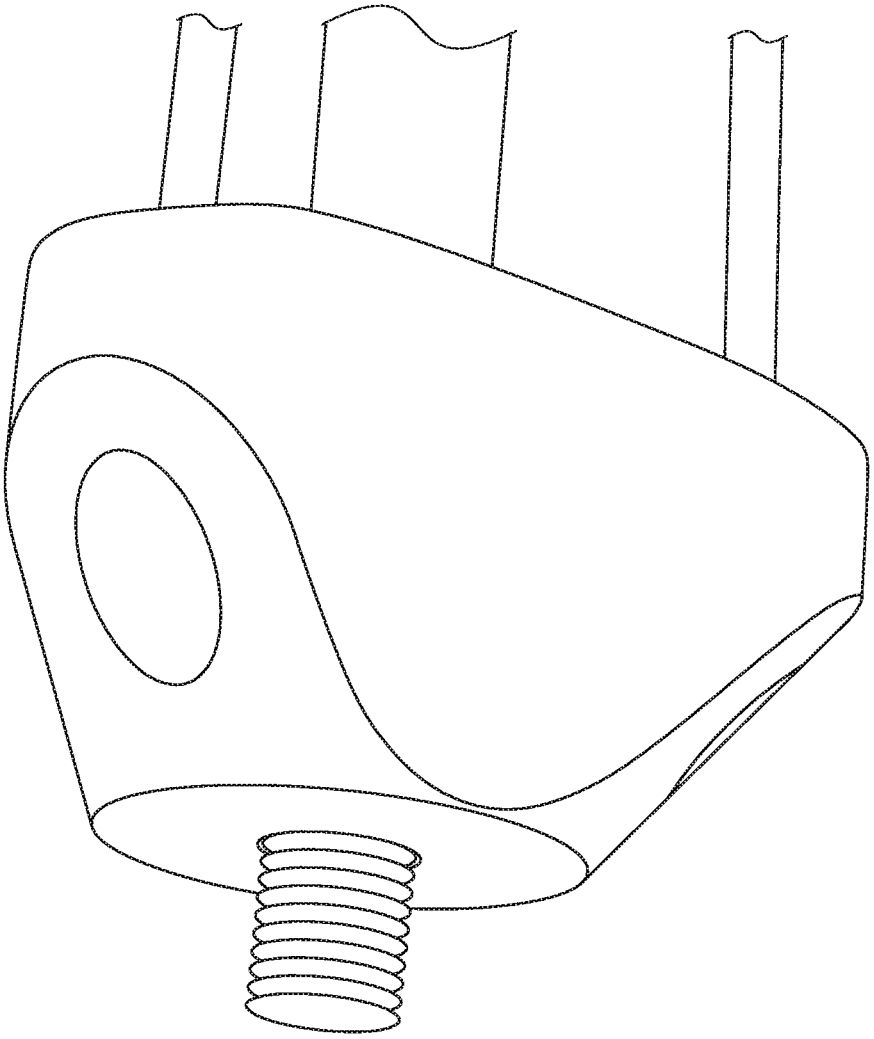
FIG. 22 shows the threaded end of a stabilizer.

FIG. 22 shows the threaded end of a stabilizer.

Figure 23:
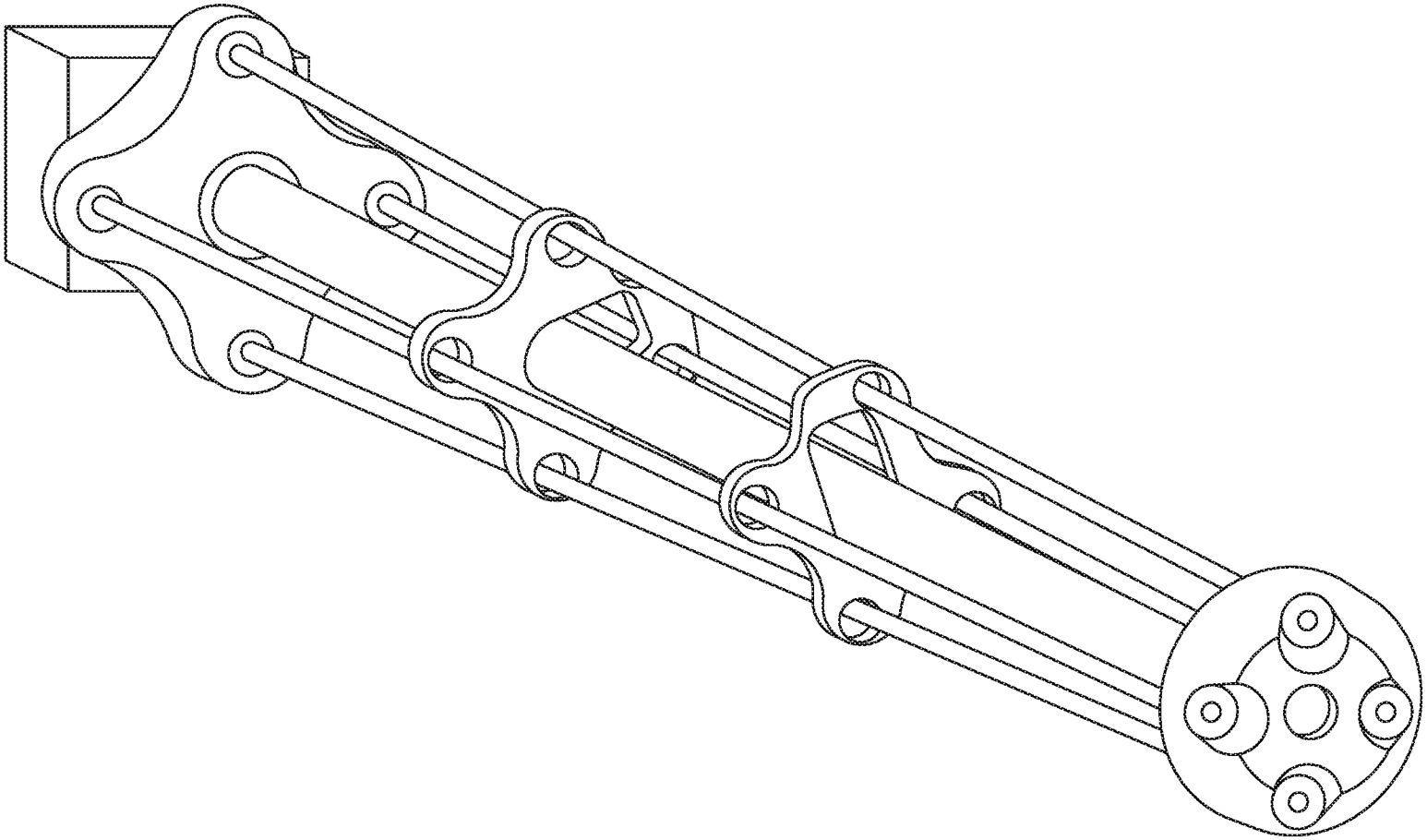
FIG. 23 shows a four wire embodiment of the inventive stabilizer.

FIG. 23 shows a four wire embodiment of the inventive stabilizer.

Figure 24:
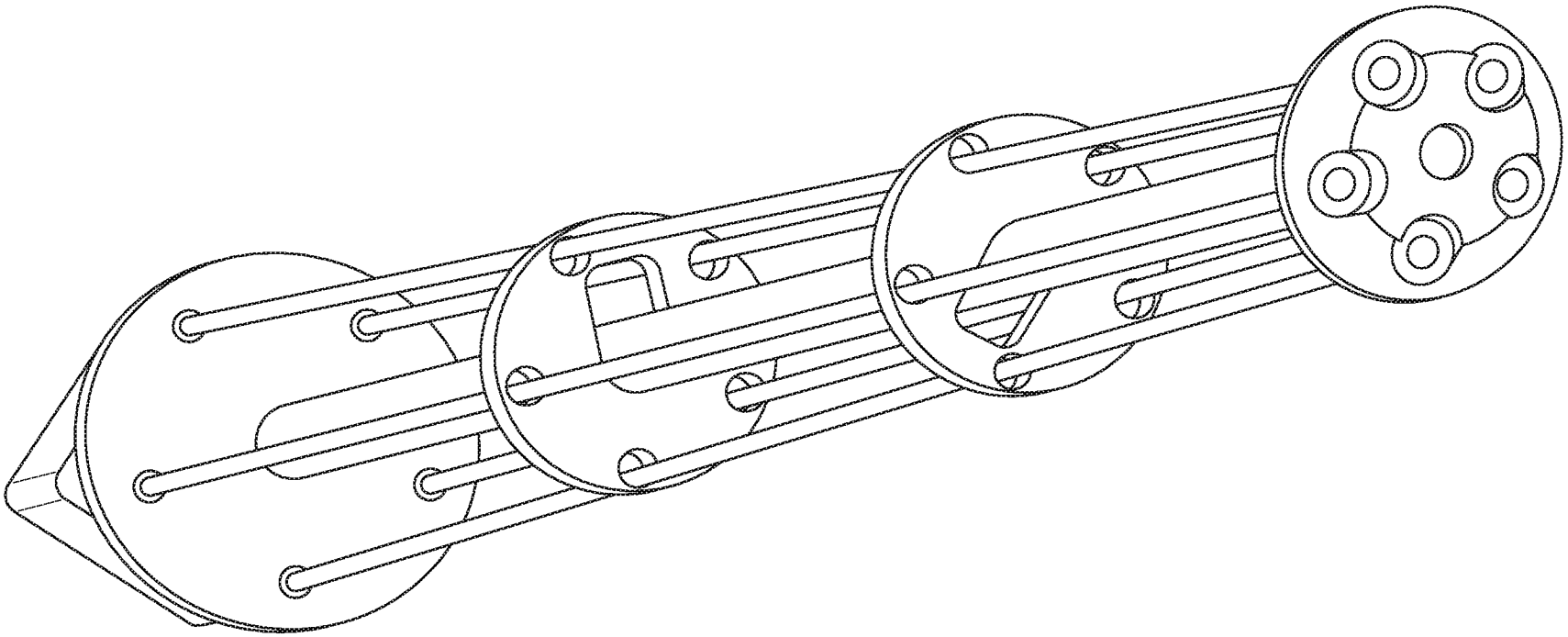
FIG. 24 shows a five wire embodiment of the inventive stabilizer.

FIG. 24 shows a five wire embodiment of the inventive stabilizer.

Figure 25:
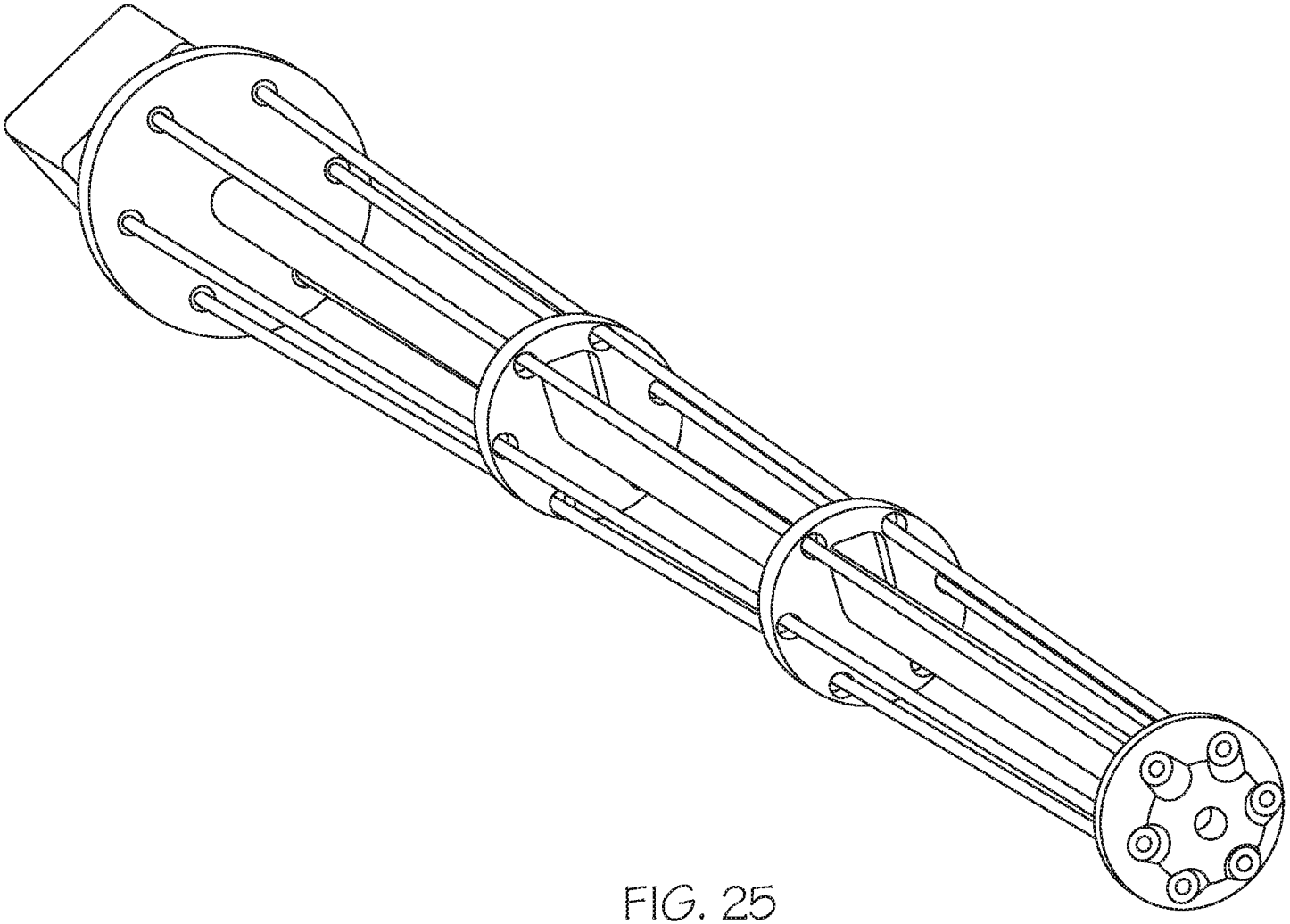
FIG. 25 shows a six wire embodiment of the inventive stabilizer.

FIG. 25 shows a six wire embodiment of the inventive stabilizer.

Figure 26:
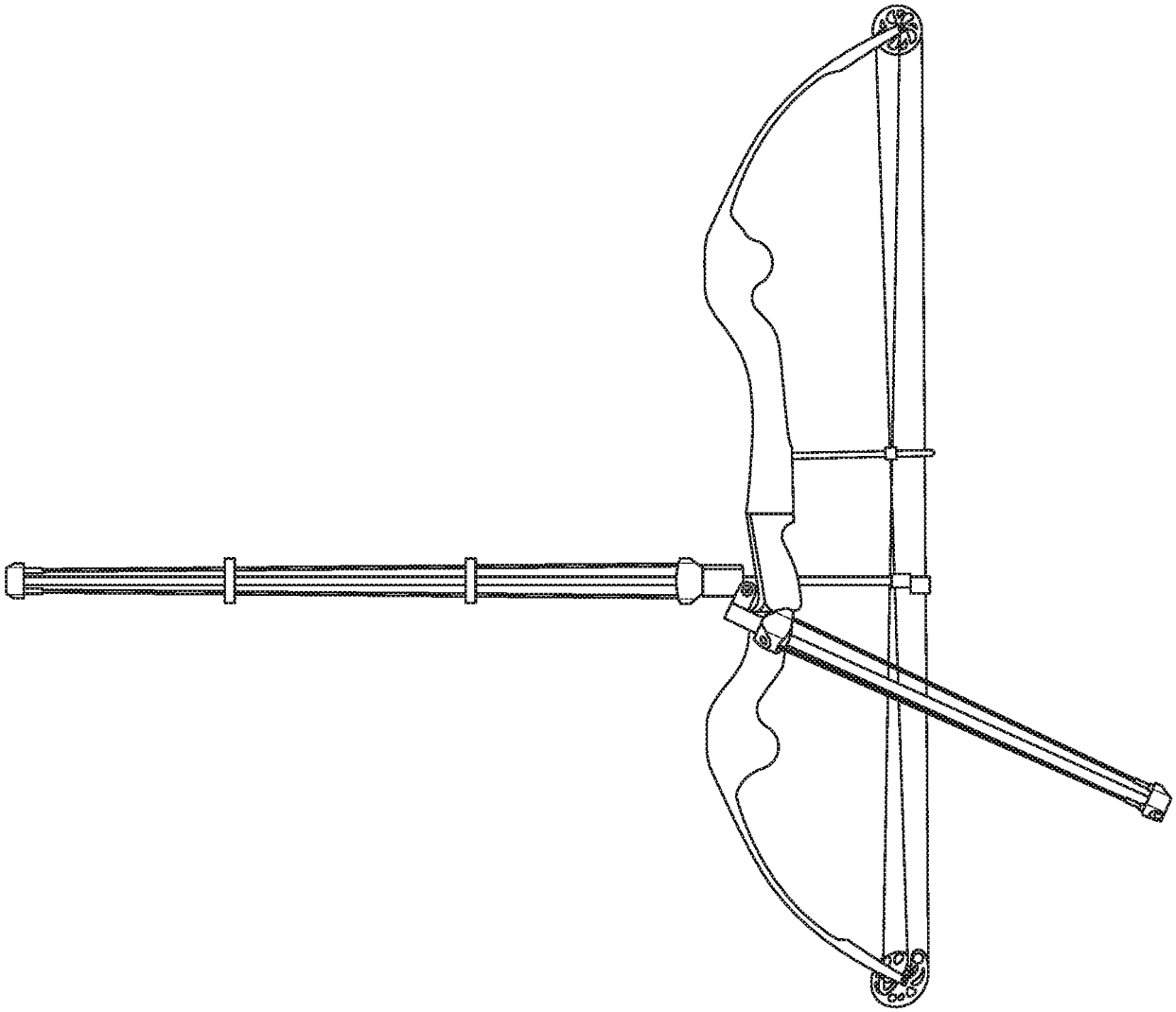
FIG. 26 shows a stabilizer with a back bar setup, mounted to an archery bow.

FIG. 26 shows a stabilizer with a back bar setup, mounted to an archery bow.

Figure 27:
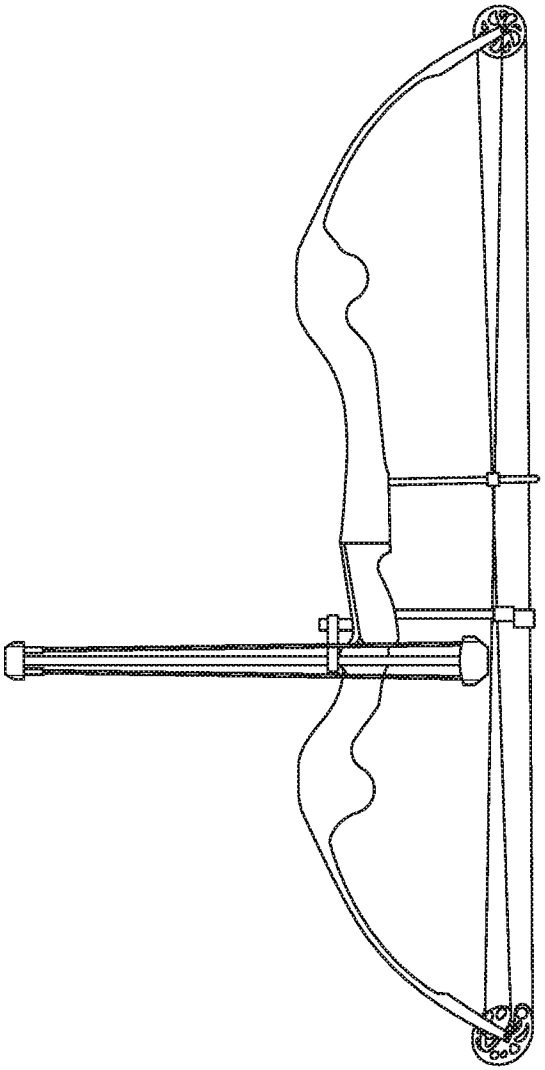
FIG. 27 shows a sidebar setup.

FIG. 27 shows a sidebar setup.

Figure 28:
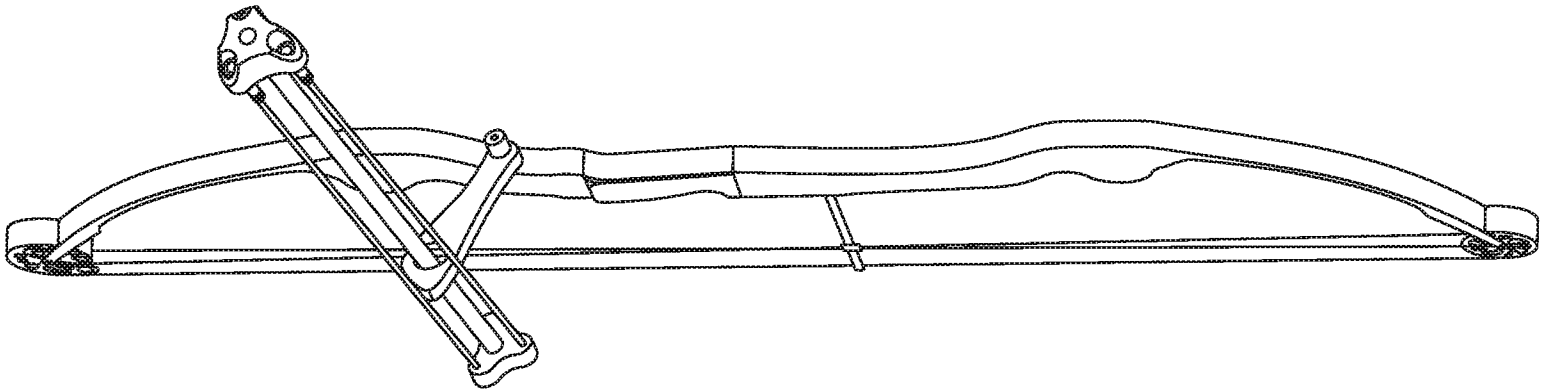
FIG. 28 shows a sidebar setup from a different angle.

FIG. 28 shows a sidebar setup from a different angle.

Figure 29:
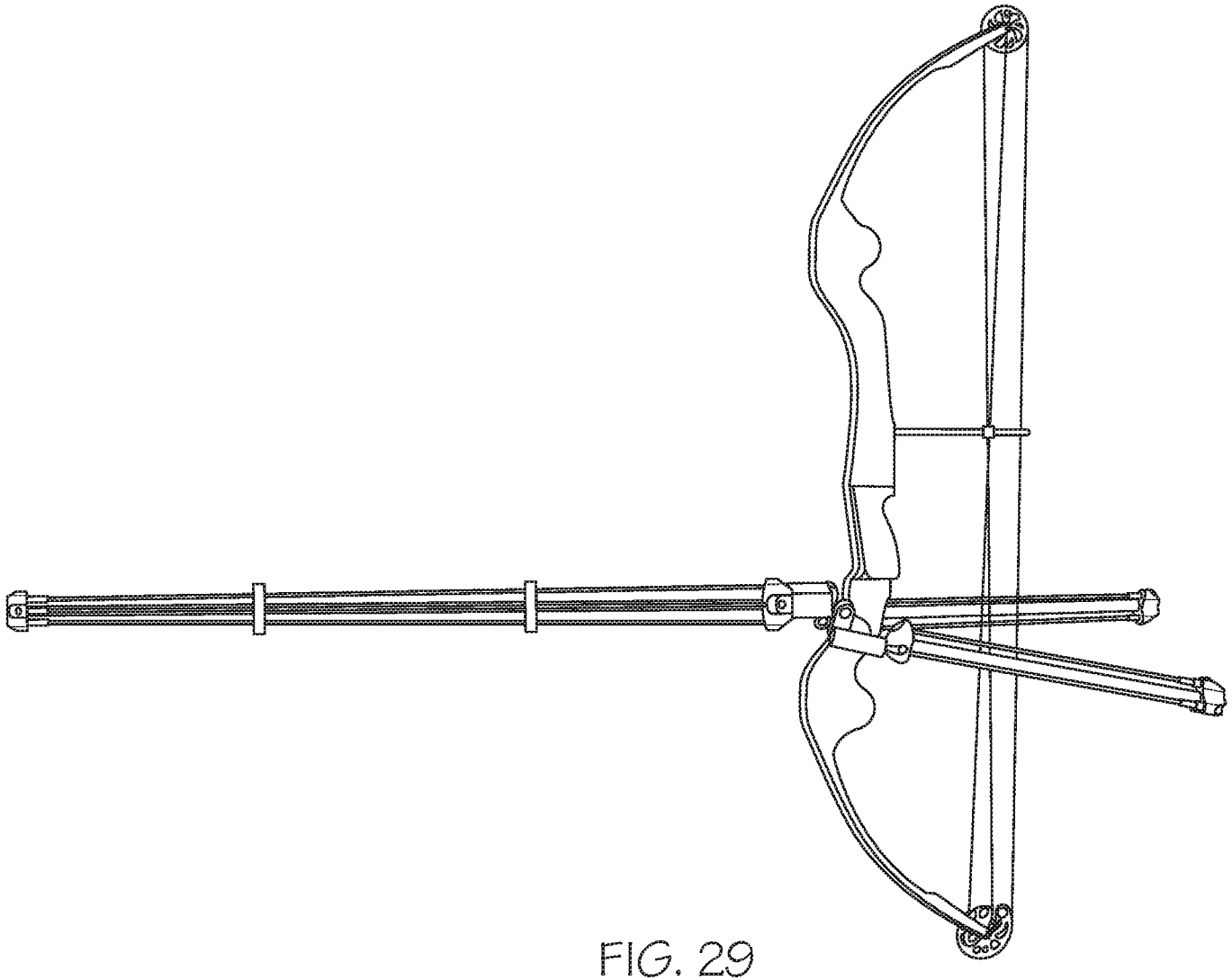
FIG. 29 shows a stabilizer setup with a v-bar.

FIG. 29 shows a stabilizer setup with a v-bar.

The stabilizer can be attached to an archery bow (compound or recurve) in a number of arrangements. This can be used as a stabilizer rod on the front mount of a bow, a rear stabilizer and a back mount, a v bar set up and a side bar setup. These are all different locations you can mount the stabilizer on a bow.

What is claimed is:

1. An archery stabilizer comprising:

a rod having first and second ends;

first and second end caps connected to the first and second ends of the rod;

at least three stiffening members extending between the first and second end caps, and spaced apart from each other, and each of the at least three stiffening members being constructed and arranged to selectively change a tension between the first and second end caps.

2. The archery stabilizer of claim 1 wherein the rod has threaded ends and the first and second end caps have mating threaded openings which can be threadably attached to the rod.

3. The archery stabilizer of claim 1 wherein the at least three stiffening members are Kevlar coated wires.

4. The archery stabilizer of claim 1 wherein the at least three stiffening members are Kevlar coated rope.

5. The archery stabilizer of claim 3 wherein an anchor end of the wire is connected to one of the first or second end caps, and an other end of the wire has a threaded end which is threadably connected to a nut and hex head connected to the other of the first and second end caps, so allow each wire to be adjusted to change a length of the wire between the first and second end caps, which changes a load on the rod, which in turn controls a stiffness and direction of the flex of energy caused by firing an archery bow.

6. The archery stabilizer of claim 1 wherein the at least three stiffening members is comprised of three wires.

7. The archery stabilizer of claim 1 wherein the at least three stiffening members is comprised of four wires.

8. The archery stabilizer of claim 1 wherein the at least three stiffening members is comprised of five wires.

9. The archery stabilizer of claim 1 wherein the at least three stiffening members is comprised of six wires.

10. The archery stabilizer of claim 1 in combination with an archery bow.

11. The archery stabilizer of claim 1 in combination with an archery bow, with the stabilizer connected to a front mount of the bow.

12. The archery stabilizer of claim 1 in combination with an archery bow, with the stabilizer connected to a rear mount of the bow.

13. Two archery stabilizers of claim 1 in combination with an archery bow, with the stabilizers connected to the archery bow in a V-bar arrangement.

14. Two archery stabilizers of claim 1 in combination with an archery bow, with the stabilizers connected to the archery bow in a side-bar arrangement.

15. The archery stabilizer of claim 1 further including a pair of supports positioned between the end caps.

16. The archery stabilizer of claim 2 wherein the rod is a carbon fiber rod.

* * * * *